United States Patent [19]

Kuhr

[11] 4,189,893

[45] Feb. 26, 1980

[54] CEILING RUNNER AND PANEL ASSEMBLY HAVING SLIDING LOCKABILITY

[75] Inventor: Albert F. Kuhr, Elk Grove Village, Ill.

[73] Assignee: United States Gypsum Company, Chicago, Ill.

[21] Appl. No.: 941,494

[22] Filed: Sep. 11, 1978

[51] Int. Cl.[2] ..... E04B 5/52

[52] U.S. Cl. ..... 52/779; 52/484

[58] Field of Search ..... 52/779, 778, 774, 775, 52/772, 484, 485

[56] References Cited

U.S. PATENT DOCUMENTS

| | | | |
|---|---|---|---|
| 3,171,232 | 3/1965 | Gretter | 52/779 |

FOREIGN PATENT DOCUMENTS

| | | | |
|---|---|---|---|
| 165114 | 9/1955 | Australia | 52/485 |
| 1419874 | 10/1965 | France | 52/484 |
| 602631 | 3/1960 | Italy | 52/484 |
| 272513 | 3/1951 | Switzerland | 52/484 |
| 304642 | 4/1955 | Switzerland | 52/484 |
| 998200 | 7/1965 | United Kingdom | 52/484 |

*Primary Examiner*—James A. Leppink
*Assistant Examiner*—Henry E. Raduazo
*Attorney, Agent, or Firm*—Glenn W. Ohlson; Robert H. Robinson; Kenneth E. Roberts

[57] ABSTRACT

A ceiling runner and panel assembly is disclosed for a suspended concealed ceiling system. The assembly provides sliding lockability and comprises vertically adjustable hanger brackets supporting inverted-T runners concealed within ceiling tile kerfed marginal edges. The ceiling tile edges have upper portions removed at periodic intervals corresponding to tab portions on the arms of the runners. The assembly provides simplified installation and accessibility of facilitating tile engagement with the inverted-T runners by lifting and shifting to slidably lock the tap portions within the kerfed edges. The ceiling is leveled by means of vertically adjustable hanger brackets rigidly supporting the runners from fixed upper support structures.

18 Claims, 2 Drawing Figures

CEILING RUNNER AND PANEL ASSEMBLY HAVING SLIDING LOCKABILITY

THE BACKGROUND OF THE INVENTION (1) Field of the Invention

This invention relates to a runner and panel assembly utilizing sliding lockability for a suspended ceiling system.

(2) Description of the Prior Art

Suspended ceiling systems are widely known to the building construction industry. Such ceilings and assemblies normally provide runners in a grid-like pattern. The runners may be loosely supported from an upper support structure by the utilization of wires or the like, or may be rigidly supported by brackets which secure the runners fixedly to the upper support structures. Typically, main runners are supported by the upper support structure while cross-runners extend transversely attached between the main runners at uniformly spaced locations to maintain tile alignment and provide the grid-like arrangement.

Generally, suspended ceiling systems utilize generally rectangular tile supported along peripheral edges. The runners conventionally have lower flange portions for this engagement. Most often, the ceiling tile engage the runners in the following manners: (1) marginal edges simply rest atop the flanges; (2) the edges are notched and rest atop the flange portions with a lower tile surface depending below the flanges; (3) the marginal peripheral edges are kerfed to provide accommodating engagement for flanges therein; or, (4) the marginal edges of the ceiling tile are gripped by spaced-apart flanges pocketing the tile edges therein.

Suspended ceiling systems utilizing the main runner and cross-runner conformation also involve combinations of concealed, semi-concealed, and exposed runner alignments. Also, recessed exposed runners provide a shadow-line effect in many assemblies. Typically, a uniform mode is provided for both cross-runners and main runners. Another common manner of aligning the main runners and cross-runners is to conceal the cross-runners from view by means of secreted flange portions while allowing main runners to be disposed in a fully exposed or shadow-line condition.

Accessibility and ease of installation are desirable qualities for suspended ceiling systems. The ability to remove individual panels to gain access at particular locations in the plenum between the upper support structure and ceiling surface is desirable. Many suspended ceiling systems provide adaptable lighting fixtures and air diffusion systems mountable on flanged runners. Additionally, utilities such as electrical wiring and plumbing may be located within this plenum area. It is therefore desirable to provide accessibility to this plenum while also permitting simple installation.

(3) Objects of the Invention

It is a primary object of this invention to provide a ceiling runner and ceiling panel assembly which is readily installed.

It is accordingly a concomitant object of this invention to provide ease of accessibility to the plenum above the suspended ceiling.

It is also an object of this invention to provide a suspended ceiling system where ceiling tile are slidably lockable with main runners.

It is an attendant object of this invention to provide a ceiling runner and ceiling tile assembly which is rigidly supported by hanger brackets having a vertical adjustability to provide a level ceiling after installation of ceiling tile.

It is a related object of this invention to provide a concealed suspended ceiling system wherein marginally kerfed ceiling tile slidably lock with inverted-T runners.

It is a related object to provide a ceiling runner and ceiling panel assembly wherein cross-runners are optional.

It is therefore also an object of this invention to provide a progressively installed suspended ceiling system wherein accessibility to the plenum may be had at any location in the suspended ceiling.

SUMMARY OF THE INVENTION

The objects of this invention are attained by providing a suspended ceiling system comprising vertically adjustable hanger brackets which depend from upper support structures and rigidly support inverted-T runners. The objects are further attained by providing the inverted-T runners in parallel spaced-apart relationship. Said inverted-T runners have web portions terminating in lower arm flanges wherein at least one of the arm flanges has notches at periodic intervals to thereby provide remaining tab portions. The objects of this invention are further attained by utilizing ceiling tile which engaged the tab portions along kerfed edges wherein the upper portions of the kerfed edge are removed at periodic intervals which correspond to the spacing of the inverted-T runner tab portions. The ceiling tile engage the inverted-T runner by being lifted and shifted to slidably lock the tab portions within the kerfed edges of the tile whereupon the ceiling is levelled by vertically adjusting the hanger brackets.

Objects of this invention are also attained by utilizing a progressively installed suspended ceiling tile system having at least one pair of parallel spaced apart inverted-T runners. The inverted-T runners have two arm flanges notched at periodic intervals to provide engageable tab portions. The ceiling tile have opposite kerfed edges with upper portions of the kerfed edges removed at periodic intervals corresponding to the tab portions. Progressive installation is attained with this system wherein the ceiling tile slidably engaged the arm flanges by being lifted and shifted between said parallel runners to either butt against longitudinally adjacent tile in edge-to-edge relation, or contact wall portions at ceiling boundaries. A desirable object of providing a concealed ceiling runner system is thereby attained.

Further objects of this invention are also reached by providing a tile and ceiling runner assembly for a suspended ceiling system utilizing vertically adjustable hanger bracket means rigidly supporting the ceiling runners. The assembly comprises a ceiling tile having kerfs in opposite marginal edges wherein upper portions of the kerfed edges are removed at periodic intervals. Two parallel ceiling runners are spaced apart a distance substantially the same as the distance between the opposite marginal kerfed edges of the ceiling tile. The ceiling runners are provided in a generally inverted-T configuration with a vertical web portion terminating at a lower edge in arm flanges which extend in opposite directions at generally right angles to the web portion. The arm flanges are notched at periodic intervals with remaining portions forming tab portions spaced apart at periodic intervals which correspond to the removed upper portions of the kerfed edge of the ceiling tile. In satisfying the objects of the invention, the tile and ceiling runners are engageable by aligning the tile beneath the runners with the removed kerfed edge portions below correspondingly spaced tab portions. The tile become engaged to the runner by lifting the tile to place the tab portions within the kerf and then shifting the tile laterally to dispose the tab portions within the kerf at unremoved upper portions thereby the tile are supportively engaged by the runner. The engaged tile and ceiling runner assembly are levelled to provide a generally planar ceiling surface by means of hanger brackets having vertical adjustment means wherein the hanger brackets rigidly secure the ceiling runners to fixed support structures.

BRIEF DESCRIPTION OF THE DRAWINGS

The foregoing and other and more specific objects of the invention are attained by the construction and arrangement illustrated in the accompanying drawings wherein.

DESCRIPTION OF THE PREFERRED EMBODIMENTS

This invention may be more fully described, but is not limited, by reference to the attached drawings and following discussion of the preferred embodiments.

Figure 1:
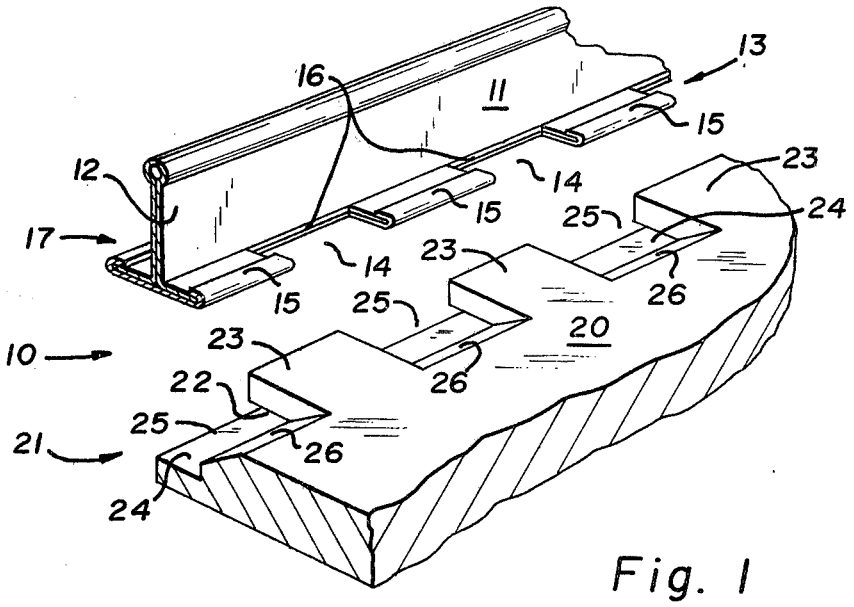
FIG. 1 is a perspective view looking downward at an exploded portion of a ceiling tile and ceiling runner assembly in accordance with the invention showing the notched inverted-T runner and ceiling tile having upper portions of the marginally kerfed edge removed in corresponding relationship.

FIG. 1 shows the preferred embodiment for tile and ceiling runner assembly 10 in accordance with this invention for use in a suspended ceiling system. Assembly 10 comprises inverted-T runner 11 and ceiling tile 20. The term ceiling tile and ceiling panel are herein used interchangeably.

Inverted-T runner 11 has a web portion 12 in generally vertical orientation with arm flanges 13 and 17 extending outwardly from a bottom edge at generally right angles thereto. The sliding lockability of this assembly is best shown with particular references to arm flange 13. Notched portions 14 have been punched from arm flange 13 at periodic intervals. The remaining portions of arm flanges 13 are denoted as tab portions 15. The desirable interval spacing of notched portions 14 is about 8" center-to-center. The width of engageable tab portion 15 is desirably disclosed to be about 5". This spacing is provided for a conventional steel main runner preferably having a gage of 0.022" for use with ½" thick mineral or wood fiber ceiling tile.

Turning now to ceiling tile 20, as shown in FIG. 1, it is illustrated in this partial portion, that ceiling tile 20 has marginal edge 21. The marginal edge 21 is provided with a centrally located kerf 22 running substantially the full length of the ceiling tile. Desirably, the assembly 10 comprises a ceiling tile having a thickness of about ½", as mentioned, having a width of about 2' and length of about 8'. The 2' dimension corresponds to the desirable center-to-center spacing of main runners 17. Kerf 22 comprises an upper portion 23 and bottom portion 24. In accordance with this invention, portions of upper portion 23 are removed at periodic intervals. These portions are noted as removed portions 25. In the preferred embodiment of this invention the removed portions 25 are located on 8" center-to-center periodic intervals synchronized with the spacing of tab portions 15. The width of removed portions 25 is desirably provided at approximately 5⅛" allowing clearance for insertion of tab portions 15 during installation of the assembly. Remaining upper portions 23 are correspondingly located on 8" centers and have a width of approximately 2⅞". An optional feature is provided in FIG. 1 for removed portions 25 and is illustrated as being bevelled surface 26 sloping upwards toward the upper surface of ceiling tile 20. This bevelled surface 26 aids installation during positioning of the tile 20.

In the desirable embodiment of this invention an opposite marginal edge (not shown) of ceiling tile 20 is provided with correspondingly spaced removed portions. Although, in accordance with this invention, the spacing and widths may be altered to conform to an associated main runner (not shown) tab spacing positioned along said opposite marginal edge.

In compliance with the objects of this invention, sliding lockability is provided by the insertion of the tab portions 15 within kerf 22. This installation procedure is accomplished by lifting ceiling tile 20 in an upward motion having the removed portions 25 in vertical registration with the tab portions 15. The ceiling tile 20 is lifted upwardly until the tab portions 15 contact the bottom portion 24 of kerf 22. At this point the installer then laterally shifts ceiling tile 20 longitudinally along inverted-T runner 20 to locate tab portions 15 within kerf 22 beneath remaining upper portions 23. The shifting movement is completed when ceiling tile 20 abuts a longitudinally adjacent tile in edge-to-edge relationship or, if used at the edge of a ceiling, when slid to contact a wall portion at the ceiling boundary. In this position, with the tab portions 15 located at the unnotched upper portions 23 of kerf 22, the ceiling tile 20 are locked in place. In providing this sliding lockability for assembly 10, it is noted that it is desirable to provide a rigidly supported inverted-T runner 17 such that when ceiling tile 20 are lifted upwardly they do not vertically displace the inverted-T runner 17 and hinder installation. It is therefore desirable that inverted-T runner 17 be rigidly supported by a bracket, or similar conventional means, connecting it to upper support structures.

In the preferred embodiment disclosed in FIG. 1, ceiling tile 20 comprises mineral fiber. However, wood fiber is equally utilitarian for assembly 10. Alternatively, various materials may be utilized for ceiling tile 20 such as wood, gypsum, or conventional acoustical ceiling tile material. In compliance with this invention, it is desirable that ceiling tile 20 have a thickness of from about ¼" to about 1", a width of from about 1' to about 4', and, a length of from about 1' to about 12'. The assembly is adaptable for use not only in office buildings, residences and factories, but is usable in mobile home construction as well. It is envisioned that by providing a panel having large longitudinal dimensions (8' to 12') a single panel may span from wall to wall, such as in, for example, a 10' by 12' room.

In the preferred embodiment disclosed in FIG. 1, it is envisioned that arm flange 13 be ½" with the corresponding depth of kerf 22 being slightly greater. However, it is desirable that notches 14 not be provided at the full width dimension of arm flange 14 but stop short of web 12 to leave a strip 16 for rigidity. It is noted that in an optional embodiment for remaining upper portions 23, they project outwardly a distance less than the bottom portion 24, where the distance is approximately equal to the lateral dimension of strip 16.

The preferred material comprising inverted-T runner 17 is steel having a gage of from about 0.018" to about 0.025", however, alternative embodiments may include such other materials as aluminum, wood, rigid vinyls or other structurally equivalent materials.

Figure 2:
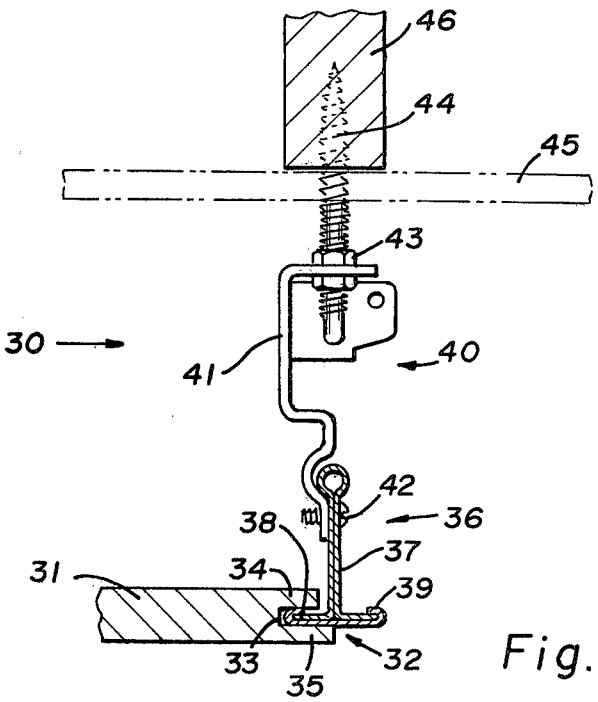
FIG. 2 is a cross-sectional view taken along a vertical plane showing the assembled suspended ceiling system in accordance with this invention wherein the ceiling tile are supportively engaged with the tab portions of an inverted-T runner which is rigidly secured to an upper support structure by a vertically adjustable hanger bracket.

Turning now to FIG. 2, the preferred embodiment for the suspended ceiling system in accordance with this invention is disclosed. FIG. 2 illustrates a portion of suspended ceiling system 30 in cross-section. Suspended ceiling system 30 comprises a ceiling tile 31 slidably locked to engage with an inverted-T runner 36. Inverted-T runner 36 is rigidly secured by a vertically adjustable hanger bracket 40 which is adjustably secured through an existing ceiling surface 45 to an upper support structure 46.

Ceiling tile 31 is preferably provided with the aforementioned dimensions and material disclosed for ceiling tile 20 of FIG. 1. Ceiling tile 1 comprises a marginal edge 32 having a centrally located kerf 33 for substantially the full length of the tile. Kerf 33 comprises an upper portion 34 and bottom portion 35. In the preferred embodiment shown in FIG. 2, upper portion 34 is disclosed as extending outwardly a distance less than bottom portion 35.

Inverted-T runner 36 is provided with substantially the same dimensions and materials as provided for inverted-T runner 17 of FIG. 1. Inverted-T runner 36 comprises tab portions 38 and 39 extending outwardly from a lower edge of web portion 37. Tab portion 38 is disclosed as being slidably locked within kerf 33. Tab portion 38 is nested within kerf 33 below remaining upper portions 34 to thereby provide locked engagement. In order to prevent vertical displacement during the lifting of ceiling tile 31 into position, prior to lateral shifting along inverted-T runner 36, a vertically adjustable hanger bracket 40 is shown rigidly securing inverted-T runner 36. Inverted-T runner 36 is affixed to hanger bracket 40 by means of a conventional screw fastener 42 penetrating web portion 37.

Hanger bracket 40 comprises a body portion 41 and vertical adjustment means 43. In practicing this invention it is within its purview that numerous embodiments for the hanger bracket may be utilized, but it is envisioned that the brackets disclosed in the following patents have desirable operability: U.S. Pat. No. 3,993,020, issued to Kuhr et al.; and, U.S. Pat. No. 3,993,419, issued to Semmerling. Vertical adjustment means 43 is desirably disclosed to provide a twin-nut screw thread adjustment mechanism. Vertical adjustment means 43 thereby provides a levelling capacity during installation of ceiling tile 31 on inverted-T runner 36.

Hanger bracket 40 is rigidly secured to an upper support structure 46 by means of securing means 44. Securing means 44 is disclosed as being a wood screw penetrating the upper support 46. Upper support 46 is disclosed as being a conventional wood joist utilized in typical building construction.

FIG. 2 thus discloses an inverted-T runner 36 rigidly secured by a hanger bracket 40 to an upper support structure 46. This rigid securement prevents vertical displacement during the upward lifting of ceiling tile 31 into position with inverted-T runner 36 prior to shifting ceiling tile 31 longitudinally along inverted-T runner 36 into sliding lockability.

The disclosed desirable embodiments for this invention illustrated in FIGS. 1 and 2 utilize main runners in parallel spaced apart relationship. They are spaced apart the distance which corresponds to the width of the ceiling tile. It is also envisioned that the main runner be provided in a concealed alignment. As best seen in FIG. 2, the bottom portions 35 of ceiling tile 31 extend outwardly a sufficient distance such that, when a corresponding ceiling tile is engaged with inverted-T runner 36 on the opposite tab portions 39, bottom portions of transversely adjacent ceiling tiles abut to provide an uninterrupted aesthetically desirable appearance when viewed from below. In an alternative embodiment of this invention, conventional cross-runners may be disposed transversely between main runners. Such cross-runners may be provided to help align adjacent ceiling panel rows and add rigidity to the ceiling system.

In the preferred embodiment of this invention disclosed in FIGS. 1 and 2, no additional supplemental fasteners are required for the sliding locking engagement between the main runners and ceiling tile. The periodic interval of the tab portions and corresponding removed upper portions has been desirably envisioned to be provided on 8" centers with the tab portions having a width of 5" and the removed portions of the kerf having a width of $5\frac{5}{8}$". It is within the scope of this invention that the spacing and widths may be altered to suit desirable installation and strength requirements as particular construction needs arise. It is similarly envisioned within the scope of this invention that the tab portion spacing on opposite arm flanges of a single main runner be staggered in correspondence to the notch spacing of ceiling tile engaged along the respective arm flanges. Concomitantly, opposite marginal edges of a tile may be provided with staggered removed portions corresponding with the spacing of the tab portions provided for engagement at the respective kerfed marginal edge. Moreover, the preferred embodiment involves inverted-T runners, but it is countenanced within the range of this invention that many flanged runner configurations are equally usable such as H-shapes, I-shapes, and other designs having arms that may be notched to provide kerf engaging tab portions.

The embodiment disclosed herein is presently considered to be the preferred form of the invention but changes and modifications may be made therein and it is intended that the claims appended hereto shall cover such changes as found within the scope of this invention.

I claim:

1. A suspended ceiling system comprising:

vertically adjustable hanger brackets depending from upper support structures and rigidly supporting inverted-T runners;

said inverted-T runners being in parallel relationship and having web portions terminating in lower arm flanges wherein at least one of the arm flanges has notches at periodic intervals thereby providing remaining tab portions;

ceiling tile engaging the tab portions along kerfed edges wherein upper portions of the kerfed edge are removed at periodic intervals corresponding to the spacing of the tab portions;

whereby the tile engage the inverted-T runners by being lifted and shifted to slidably lock the tab portions within the kerfed edges of the tile; and, whereby the ceiling is levelled by means of vertically adjustable hanger brackets.

2. A suspended ceiling system as claimed in claim 1 wherein the notched portions of the arm flanges are generally rectangular and stop short of the web portion to leave a strip portion of the arm flange remaining adjacent said web portion.

3. A suspended ceiling system as claimed in claim 2 wherein the remaining upper portion of the kerfed edge extends outwardly a distance less than the bottom portion of the kerfed edge.

4. A suspended ceiling system as claimed in claim 1 wherein the bottom portions of the kerfed edges extend outwardly a sufficient distance to flushly abut corresponding bottom portions of transversely adjacent ceiling tile whereby inverted-T runner tab portions are concealed within the tile kerfs to provide an uninterrupted ceiling surface when viewed from below.

5. A suspended ceiling system as claimed in claim 1 wherein the inverted-T runners are parallel main runners rigidly attached to upper support structures by the hanger brackets wherein cross-runners are provided between said main runners.

6. A suspended ceiling system as claimed in claim 1 wherein two opposite edges of ceiling tile are kerfed with upper portions thereof removed and wherein the removed portions terminate in bevelled surfaces intersecting the top surface of the tile.

7. A suspended ceiling system as claimed in claim 6 wherein the periodic interval spacings of the upper removed portions on opposite kerfed edges are staggered.

8. A suspended ceiling system as claimed in claim 1 wherein the ceiling tile are of a width of from about one foot to about four feet and have a length of from about one foot to about twelve feet with a thickness of from about one-quarter inch to about one inch.

9. A suspended ceiling system as claimed in claim 1 wherein the inverted-T runners each have two arm flanges extending outwardly at generally right angles from the bottom of the web portion for a distance of from about one-quarter inch to about three-quarter inches.

10. A suspended ceiling system as claimed in claim 9 wherein opposite arm flanges of at least one runner have tab portions in staggered intervals.

11. A progressively installed suspended ceiling tile system having at least one pair of parallel spaced apart inverted-T runners having two arm flanges notched at periodic intervals to provide engageable tab portions, said ceiling tile having opposite kerfed edges with upper portions of the kerfed edges removed at periodic intervals corresponding to the respective runner tab portions whereby ceiling tile slidably engage the arm flanges by being lifted between said parallel runners and slid longitudinally on said runners to lock said tab portions within the kerfed edge.

12. A suspended ceiling system as claimed in claim 11 wherein the opposite kerfed edges have different interval periods for the removed upper portions each corresponding to inverted-T runner tab spacing at the respective tile edge.

13. A suspended ceiling system as claimed in claim 11 wherein the inverted-T runners are main runners having cross-runners therebetween wherein said main runners are supported by rigid connection to hanger brackets which are vertically adjustable to level the ceiling during the progressive installation of tile.

14. A tile and ceiling runner assembly in a suspended ceiling system utilizing a vertically adjustable hanger bracket means for rigidly supporting ceiling runners wherein said assembly comprises:

ceiling tile having kerfs in opposite marginal edges wherein upper portions of the kerfed edges are removed at periodic intervals;

two parallel ceiling runners spaced apart a distance substantially the same as the distance between the opposite marginal edges of said ceiling tile, wherein said ceiling runners have a generally inverted-T configuration having a vertical web portion terminating at a lower edge in arm flanges which extend in opposite directions at generally right angles to the web portion, wherein said arm flanges have notches at periodic intervals with remaining portions forming tab portions spaced apart at periodic intervals corresponding to said removed upper portions of the kerfed edge of said ceiling tile;

wherein said tile and ceiling runners are engageable by aligning the tile beneath the runners with the removed kerfed edge portions below correspondingly spaced tab portions, lifting said tile to place the tab portions within the kerf, and shifting the tile laterally to dispose the tab portions within said kerf at unremoved upper portions of the kerfed edge thereby the tile is supportively engaged by said runner, and the tile and ceiling runner assembly provides a level ceiling surface by means of hanger brackets having vertical adjustment means wherein said hanger brackets rigidly secure said ceiling runners to fixed support structures.

15. A tile and ceiling runner assembly as claimed in claim 14 wherein the periodic interval spacing is the same at both opposite marginal edges.

16. A tile and ceiling runner assembly as claimed in claim 14 wherein the periodic interval spacing is different at said opposite marginal edges.

17. A tile and ceiling runner assembly as claimed in claim 14 wherein the arm flanges are concealed within said kerfs when viewed from below.

18. A tile and ceiling runner assembly as claimed in claim 14 wherein the notched portions of the arm flanges are generally rectangular and stop short of the web portion to leave a strip portion of the arm flange remaining adjacent said web portion.

* * * * *